US006024320A

United States Patent [19]

Schippers et al.

[11] Patent Number: 6,024,320

[45] Date of Patent: Feb. 15, 2000

[54] YARN TRAVERSING MECHANISM FOR WINDING APPARATUS

[75] Inventors: Heinz Schippers; Wolfgang Heinemann, both of Remscheid; Arno Thiel, Wermelskirchen, all of Germany

[73] Assignee: Barmag AG, Remscheid, Germany

[21] Appl. No.: 09/077,975

[22] PCT Filed: Oct. 8, 1997

[86] PCT No.: PCT/EP97/05538

§ 371 Date: Nov. 13, 1998

§ 102(e) Date: Nov. 13, 1998

[87] PCT Pub. No.: WO98/16458

PCT Pub. Date: Apr. 23, 1998

[30] Foreign Application Priority Data

Oct. 12, 1996 [DE] Germany ..... 196 42 115

[51] Int. Cl.[7] ..... B65H 54/28

[52] U.S. Cl. ..... 242/481.7; 242/477.1

[58] Field of Search ..... 242/481.7, 474.5, 242/475.7, 477.1, 480.4

[56] References Cited

U.S. PATENT DOCUMENTS

| | | | |
|---|---|---|---|
| 4,505,436 | 3/1985 | Schippers et al. | 242/481.7 |
| 4,505,437 | 3/1985 | Schippers et al. | 242/481.7 |
| 4,674,694 | 6/1987 | Hasegawa et al. | 242/477.1 |
| 4,789,112 | 12/1988 | Schippers et al. . | |
| 4,969,607 | 11/1990 | Busenhart et al. | 242/474.5 |
| 5,029,762 | 7/1991 | Behrens et al. | 242/481.7 |
| 5,526,995 | 6/1996 | Westrich et al. . | |
| 5,624,081 | 4/1997 | Turk et al. | 242/481.7 |

FOREIGN PATENT DOCUMENTS

| | | |
|---|---|---|
| 0 114 642 | 5/1986 | European Pat. Off. . |
| 0 256 383 | 1/1990 | European Pat. Off. . |
| 0 374 536 | 3/1994 | European Pat. Off. . |
| 0 677 019 | 10/1995 | European Pat. Off. . |
| 0 583 469 | 12/1995 | European Pat. Off. . |
| 34 17 457 | 10/1991 | Germany . |
| WO 94/14694 | 7/1994 | WIPO . |

*Primary Examiner*—Donald P. Walsh
*Assistant Examiner*—Collin A. Webb
*Attorney, Agent, or Firm*—Alston & Bird LLP

[57] ABSTRACT

A winding apparatus for winding a continuously advancing yarn to a package. In this process, the yarn is reciprocated by means of a rotary blade type traversing apparatus along a predetermined traverse stroke. In so doing, the yarn is alternately guided within the traverse stroke along a guiding edge of a main guide plate and along an opposite guiding edge of an auxiliary guide plate. The guiding edge of the main guide plate and the opposite guiding edge of the auxiliary guide plate extend through the traversing plane in opposite directions. The auxiliary guide plate is movable transverse to the traversing plane such that the opposite guiding edge of the auxiliary guide plate extends to a lesser extent or does not extend through the traversing plane.

14 Claims, 6 Drawing Sheets

YARN TRAVERSING MECHANISM FOR WINDING APPARATUS

BACKGROUND OF THE INVENTION

The invention relates to a yarn traversing mechanism for use in a winding apparatus for winding a continuously advancing yarn onto a rotating bobbin to form a yarn package.

A yarn winding apparatus of the described type is known from EP 0 677 019 and corresponding U.S. Pat. No. 5,624,081. In this apparatus, the yarn is reciprocated by means of a traversing apparatus in a direction transverse to the direction of the advancing yarn along a predetermined traverse stroke. The traversing apparatus is of the rotary blade type. It is therefore necessary that for purposes of equalizing the traversing speed over the entire traverse stroke, the yarn be deflected from the traversing plane by means of a guiding edge of a guide plate. This permits compensation of differences in the yarn guiding speeds of the rotary blade. Moreover, to equalize the looping angles on the guiding edges which occur as a result of deflecting the yarn, the known winding apparatus is provided in each end region of the traverse stroke with an auxiliary guide plate. Each of these auxiliary guide plates penetrates with its opposite guiding edge the traversing plane such as to deflect the yarn in the opposite direction.

With the above arrangement, the problem arises that during a package doff, the yarn is not freely deflectable in the stroke end regions and, thus, cannot be removed from the traversing range. In the stroke end regions, the deflection of the yarn is limited by the guiding edge of the main guide plate and the opposite guiding edge of the auxiliary guide plate.

Accordingly, it is the object of the invention to further develop a winding apparatus of the initially described kind such that in the stroke end regions, the yarn can be removed from the traversing apparatus for purposes of doffing a package. A further object of the invention is to make the length of the traverse stroke variable.

SUMMARY OF THE INVENTION

The above and other objects and advantages of the present invention are achieved by the provision of a yarn traversing apparatus for a yarn winding apparatus which comprises at least two guide arms mounted for rotation about closely adjacent parallel or coaxial axes so that the rotating arms define closely adjacent parallel planes and the extremity of each rotating arm is adapted to pass along the traverse plane. A drive is provided for rotating each of the arms in opposite directions so that one arm moves in a direction toward one end of the traverse stroke and the other arm moves in the opposite direction toward the other end thereof. Also, a main yarn guide plate is mounted on one side of the traverse plane and defines a main guide edge which extends in a direction generally parallel to the traverse stroke and through the traverse plane in a medial portion of the yarn traverse stroke to thereby guide the yarn and control its traversing speed, and an auxiliary yarn guide plate is positioned in at least one of the end regions of the traverse stroke and on the other side of the traverse plane, with the auxiliary guide plate defining an auxiliary guide edge which opposes the main guide edge.

In accordance with the invention, the auxiliary guide plate is movable in a direction transverse to the traversing plane such that its opposite guiding edge penetrates the traversing plane to a lesser extent or not at all. Thus, in a sectional region between a point of transition and the stroke reversal point, the yarn is guided by the rotary blade. In this arrangement, the point of transition is the position, in which the guiding edge of the main guide plate penetrates the traversing plane, so that in this partial region, the guiding edge extends until reaching the traverse stroke end outside of the traversing plane. Thus, in the point of transition the yarn disengages from the guiding edge of the main guide plate. Since the opposite guiding edge of the auxiliary guide plate, which serves to deflect the yarn, is removed from the traversing plane, the yarn is free for being received by a yarn catching element, which moves the yarn out of the radius of action of the rotary blades. The advantage of the invention lies in that, because of the absence of the opposite guiding edge, the yarn slips from the tip of the guiding rotary blade already before reaching the stroke reversal point. On the one hand, this allows to accomplish a stroke reduction and, on the other hand, to avoid that the yarn tension drops during the package doff, so as to prevent faulty winds on the package by, for example, a so-called slough.

Furthermore, the winding apparatus of the present invention has the advantage that during the doff, the yarn can be received with certainty by the yarn catching element, since the yarn is guided only by the rotary blade and, thus, is repeatedly offered to the yarn catching element.

The main guide plate and the auxiliary guide plate may be positioned in a common plane. This has the advantage that the trailing length of the yarn is nearly constant. In this connection, the trailing length is defined as the length between the guiding edge of the guide plate and the point of contact on the contact roll. It is therefore possible to maintain an exact length of the traverse stroke.

The arrangement of the main guide plate and the auxiliary guide plate upstream of the rotary blades is especially advantageous for the operation and for threading the yarn.

In this connection, a configuration wherein the main guide plate is located on the drive side of the rotary blades with respect to the traversing plane, and the auxiliary guide plate is located on the other side of the traversing plane, represents a particularly favorable and simple type of construction of the main guide plate.

Another, especially advantageous further development provides that, adjacent the auxiliary guide plate, a yarn catching element is arranged, which can be moved into the end region of the traverse stroke for receiving the yarn from the traversing range. In this instance, the yarn catching element is positioned such that the caught yarn does not advance onto the full package in the direct vicinity of the reversal point. Thus, the yarn continues to be reliably deposited on the package.

In this connection, it is advantageous to design and construct the yarn catching element to include a guiding edge and a yarn catching slot formed at one end of the guiding edge, and such that the yarn is guided by the traversing apparatus directly into the slot of the yarn catching element. The looping of the yarn about the guiding edge of the catching element prevents significant fluctuations in the yarn tension from occurring until the yarn is caught.

In particular, when transferring the yarn into the traversing apparatus, it is advantageous to couple the movements of the auxiliary guide plate and the movement of the catching element. This allows for a continuous transition to be accomplished without yarn accumulations between the yarn reserve formed on the bobbin tube and the first yarn wind within the traverse stroke. To realize the coupling of the sequence of movements, same can be defined by predetermined laws of movement, such as, for example, by gear units.

To remove the yarn from the traversing apparatus and to transfer same to the traversing apparatus, it will further be of advantage when, under a law of movement, the movements of the auxiliary guide plate and the yarn catching element are synchronized.

In an especially advantageous embodiment of the takeup machine, the opposite guiding edge of the auxiliary yarn guide plate is used to free the yarn from the slot of the catching element.

The movement of the auxiliary guide plate in its operating position may be limited by a stop. This is especially advantageous, when it comes to obtain in each winding cycle reproducible looping angles on the guiding edges.

In one embodiment, only the auxiliary yarn guide plate in one of the end regions of the traverse stroke is moveable, and the auxiliary yarn guide plate at the other end region is fixed. This is advantageous, in particular during a package doff, since the sequences of movements between the yarn catching element and the movable sectional guide plate can be combined in simple manner.

To vary the length of the traverse stroke while forming the package and to thus realize a so-called stroke modification, the auxiliary yarn guide plates at the two end regions of the traverse stroke may be fixedly interconnected so as to be moveable in unison.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
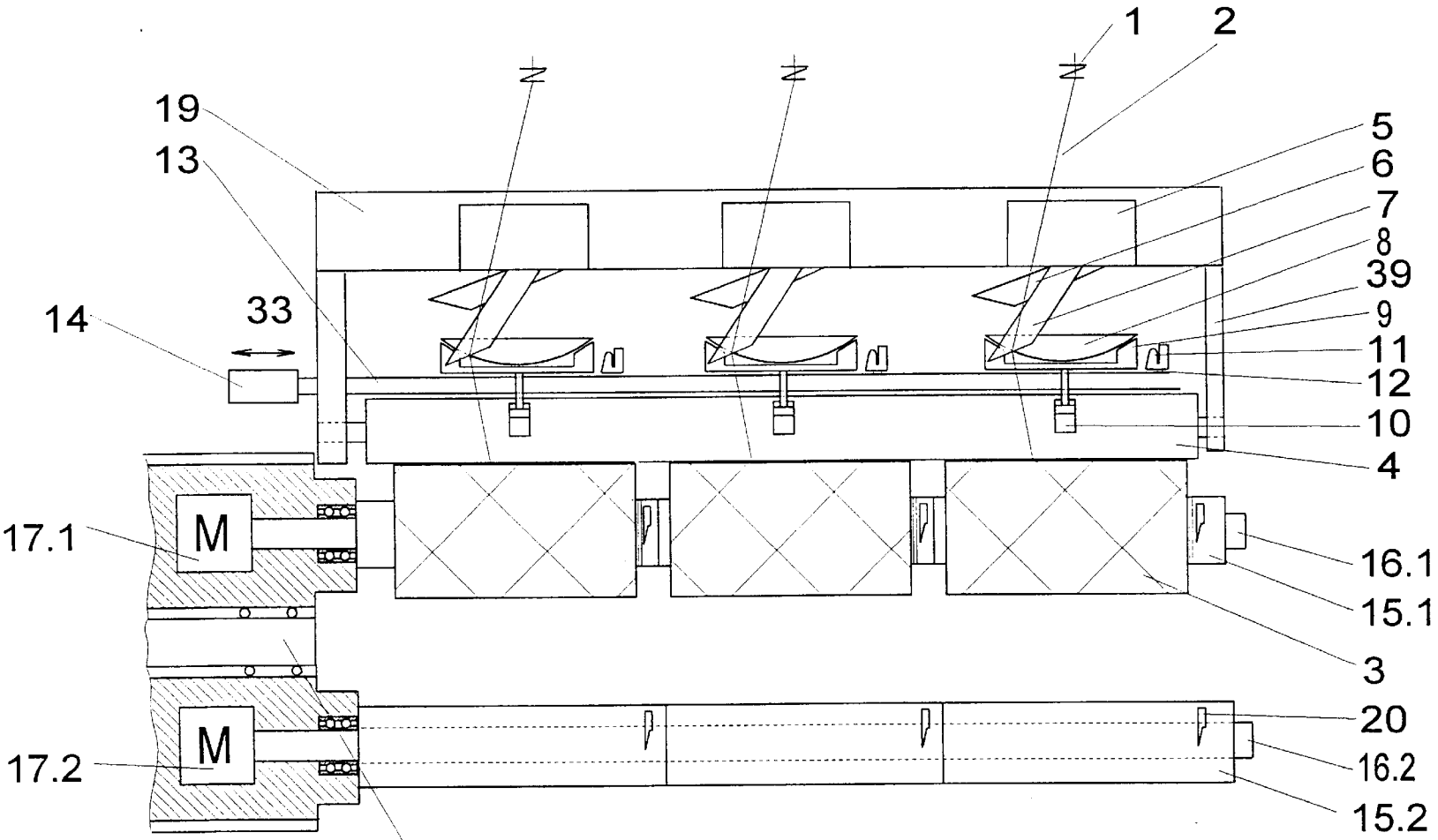
FIG. 1 is a front view of a winding machine in accordance with the invention.

Shown in FIG. 1 is a front view of a winding machine in accordance with the invention. In this machine, a yarn 2 advances via an apex yarn guide 1 to a yarn traversing apparatus. The yarn traversing apparatus is of the rotary blade type, as is known from EP 0 114 642 and corresponding U.S. Pat. No. 4,505,436. The rotary blade type traversing apparatus comprises rotary blades 6 and 7, which are driven in opposite directions by a traverse drive 5. In a plane parallel to rotary blades 6 and 7, a main guide plate 8 is arranged. An auxiliary guide plate 9 extends opposite to main guide plate 8. The auxiliary guide plate 9 is connected to a linear drive 10. In a plane parallel to auxiliary guide plate 9, a linear guideway 13 mounts a yarn catching element 11 with a support 12. The linear guideway 13 is moved by means of a drive 14 in direction 33. Downstream of the yarn traversing apparatus, a contact roll 4 is supported for rotation on a rocker arm 39 that is mounted on a machine frame 19. The contact roll 4 rests under a predetermined contact pressure against the surface of a package 3. The package 3 is formed on a tube 15.1, which is supported on a winding spindle 16.1. The winding spindle 16.1 is driven by means of a spindle motor 17.1 at a rotational speed that is controlled such that the circumferential speed of the package remains constant during the winding. To this end, the rotational speed of the contact pressure roll is measured. The winding spindle 16.1 is supported in a turret 18. The turret 18 mounts a second spindle 16.2 180° out of phase of spindle 16.1. An empty tube 15.2 is supported on winding spindle 16.2.

In the illustrated winding machine, a yarn 2 advances continuously at a constant speed. Initially, the yarn 2 is guided through yarn guide 1, which forms the apex of a yarn traversing triangle. Subsequently, the yarn reaches the rotary blade type traversing apparatus comprising the two rotary blades 6 and 7, which are mounted on two rotors (not shown). The rotors rotate in different directions and drive the rotary blades such as to alternatingly guide the yarn along the edges of the main guide plate and the auxiliary guide plate. In so doing, the one rotary blade assumes the guiding in the one direction and then moves below the guide plate, while the other rotary blade takes over the guiding in the other direction and then moves below the guide plate. Downstream of the traversing apparatus, the yarn is deflected on contact roll 4 by more than 90° and, finally, wound on package 3. The package 3 is formed on tube 15.1. The tube 15.1 is supported on freely rotatable winding spindle 16.1. The winding spindle 16.1 with tube 15.1 supported thereon is in its operating position. At this time, the second winding spindle 16.2 is in a standby position. Once package 3 is fully wound, the winding spindles 16.1 and 16.2 are rotated by means of turret 18 such that winding spindle 16.2 with empty tubes 15.2 thereon engage the advancing yarn. The sequence of movements that is performed in this process will be described further below.

Figure 3:
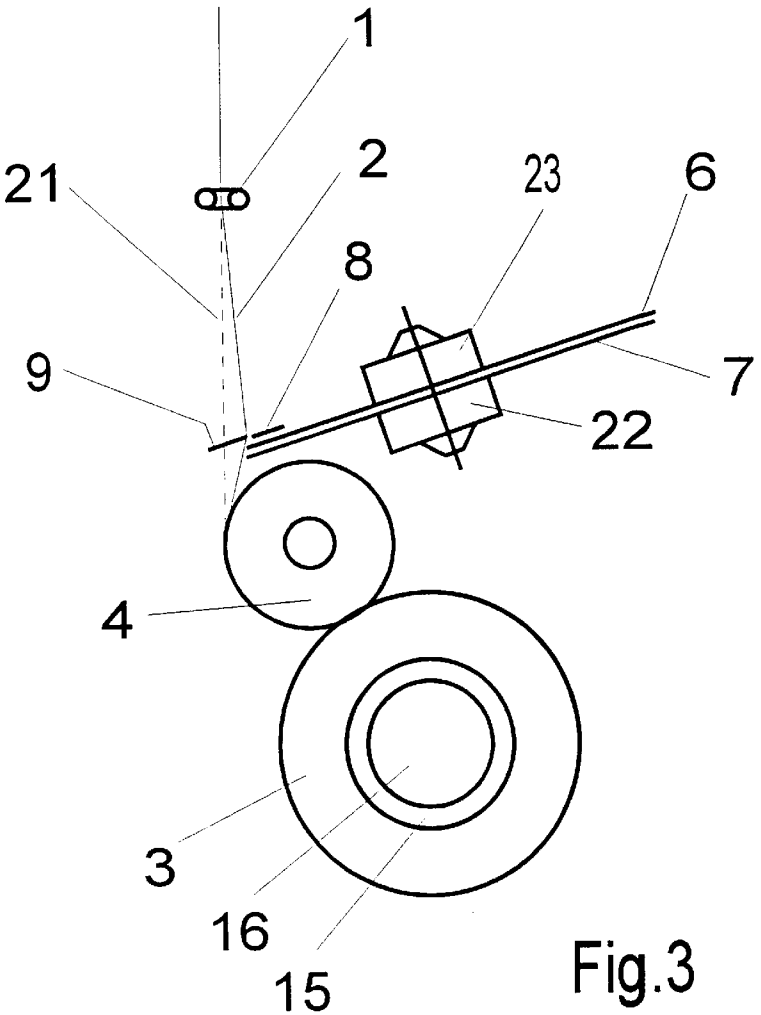
FIGS. 2 and 3 are each a side view of the winding machine of FIG. 1 with different yarn positions along the traverse stroke.
Figure 2:
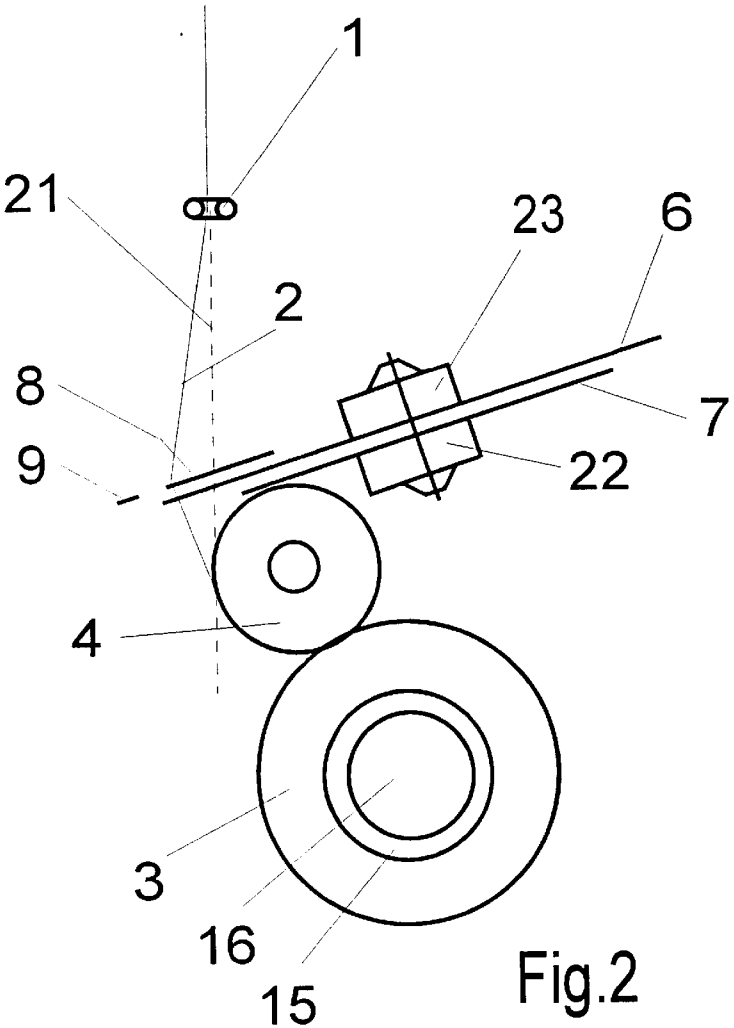

FIGS. 2 and 3 are each a side view of the takeup machine with different yarn positions along the traverse stroke. In comparison with the arrangement of FIG. 1, the traversing apparatus is shown by rotors 22 and 23, the rotor 22 mounting rotary blade 7 and rotor 23 rotary blade 6. The rotors 22 and 23 are arranged such that the rotary blades 6 and 7 are rotated in two closely adjacent, parallel planes of rotation. A traversing plane 21 extends between apex yarn guide 1 and contact roll 4.

In the situation illustrated in FIG. 2, the yarn 2 is guided by rotary blade 6 along main guide plate 8. In this instance, the yarn 2 is deflected from traversing plane 21. This situation corresponds to the yarn path in the medial region of the traverse stroke.

Contrary to the foregoing, FIG. 3 illustrates the situation in the end regions of the traverse stroke. In this instance, rotary blade 6 guides the yarn along auxiliary guide plate 9. In so doing, the yarn 2 is deflected from the traversing plane in opposite direction to the deflection in the stroke center. It is achieved by this arrangement that the looping angles on the main guide plate and the auxiliary guide plate are approximately equal in the extreme points of deflection from the traversing plane. This allows to prevent a significant drop of the yarn tension in the stroke end regions.

Figure 4:
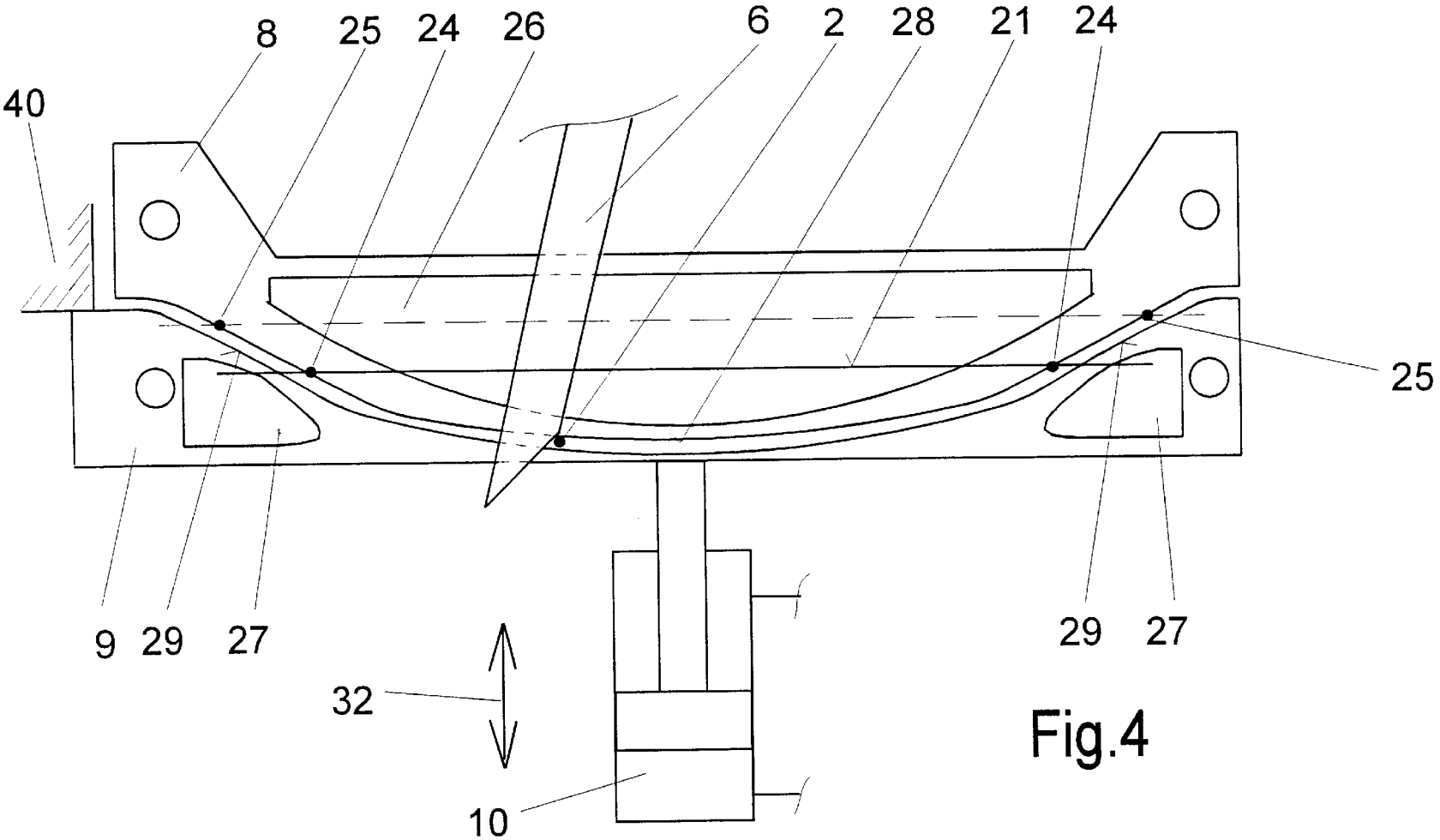
FIGS. 4 and 5 are each a schematic top view of a traversing apparatus with a main guide plate and an auxiliary guide plate.

FIG. 4 is a schematic top view of a traversing apparatus with a main guide plate and an auxiliary guide plate. The main guide plate 8 is mounted on the drive side of the traversing apparatus such that its guiding edge 28 extends through traversing plane 21 in the points of transition 24. Thus, the yarn 2 is guided by the rotary blades of the traversing apparatus within the traverse stroke between the points of transition, namely in the medial region, along the guiding edge 28. In the sectional regions of the traverse stroke that adjoin the medial region, the auxiliary guide plate 9 is arranged opposite to main guide plate 8. In the illustration, the auxiliary guide plate 9 comprises an opposite guiding edge 29 that extends through traversing plane 21 in direct vicinity of transition points 24 in direction toward the drive side. The opposite guiding edge 29 of auxiliary guide plate 9 extends beyond the stroke reversal points. This allows to accomplish that as soon as yarn 2 while being guided along edge 28 passes transition point 24, it will move from guiding edge 28 over to guiding edge 29 upon crossing the traversing plane. The yarn is then guided along opposite guiding edge 29 in the region between transition point 24 and reversal point 25. In reversal point 25, the rotary blade guiding the yarn at the time moves below the main guide plate and the nonguiding rotary blade takes over the yarn.

The mobility of auxiliary guide plate 9 permits variation of the stroke reversal point of the yarn during the winding. As a result, it is possible to influence the traverse stroke in favorable manner and, thus, likewise the yarn deposit on the package being formed, so as to avoid both hard package edges and a saddle formation on the package.

Therefore, in the operating position of auxiliary guide plate 9, the yarn path extends in such a manner that the yarn is guided in the medial region of the traverse stroke along guiding edge 28 of main guide plate 8. This medial region is defined by the region between transition points 24. Outside the medial region in the adjacent end regions, the yarn is guided along opposite guiding edge 29 between transition point 24 and stroke reversal point 25. If auxiliary guide plate 9 is now displaced by means of linear drive 10 in direction of movement 32 substantially perpendicular to the traversing plane, the yarn will disengage from guiding edge 28 of main guide plate 8 upon entering into a sectional region adjacent to the medial region. The yarn is now guided exclusively by the guiding rotary blade. Since the opposite guiding edge 29 causes no deflection from the traversing plane, the yarn remains in the traversing plane. Therefore, as rotation of the rotary blade increases, the yarn moves along the guiding edge of the blade until it drops from the tip thereof. The yarn can no longer be guided by the rotary blade to stroke reversal point 25. Thus, a reduction of the traverse stroke occurs, which can advantageously be used for regulating the mass distribution on the package.

In the embodiment of the traversing apparatus as shown in FIG. 4, the auxiliary guide plate 9 with its opposite guiding edge 29 is arranged on the side facing the guide plate 8 with its guiding edge 28. To be able to thread the yarn in the traversing apparatus, the auxiliary guide plate 9 is displaced by means of linear drive 10 such as to increase the spacing between guiding edge 28 and opposite guiding edge 29. This permits threading of the yarn or removal of same by a yarn catching element, when changing from a full package to an empty tube. After a rotary blade engages yarn 2 while being threaded, the linear drive moves auxiliary guide plate 9 to its operating position. The operating position is predetermined by a stationary stop 40. To reduce mass, windows 27 are cut out of the auxiliary guide plate in the stroke end regions. Likewise, for purposes of reducing mass, the main guide plate 8 contains a cutout in the form of a window 26.

Figure 5:
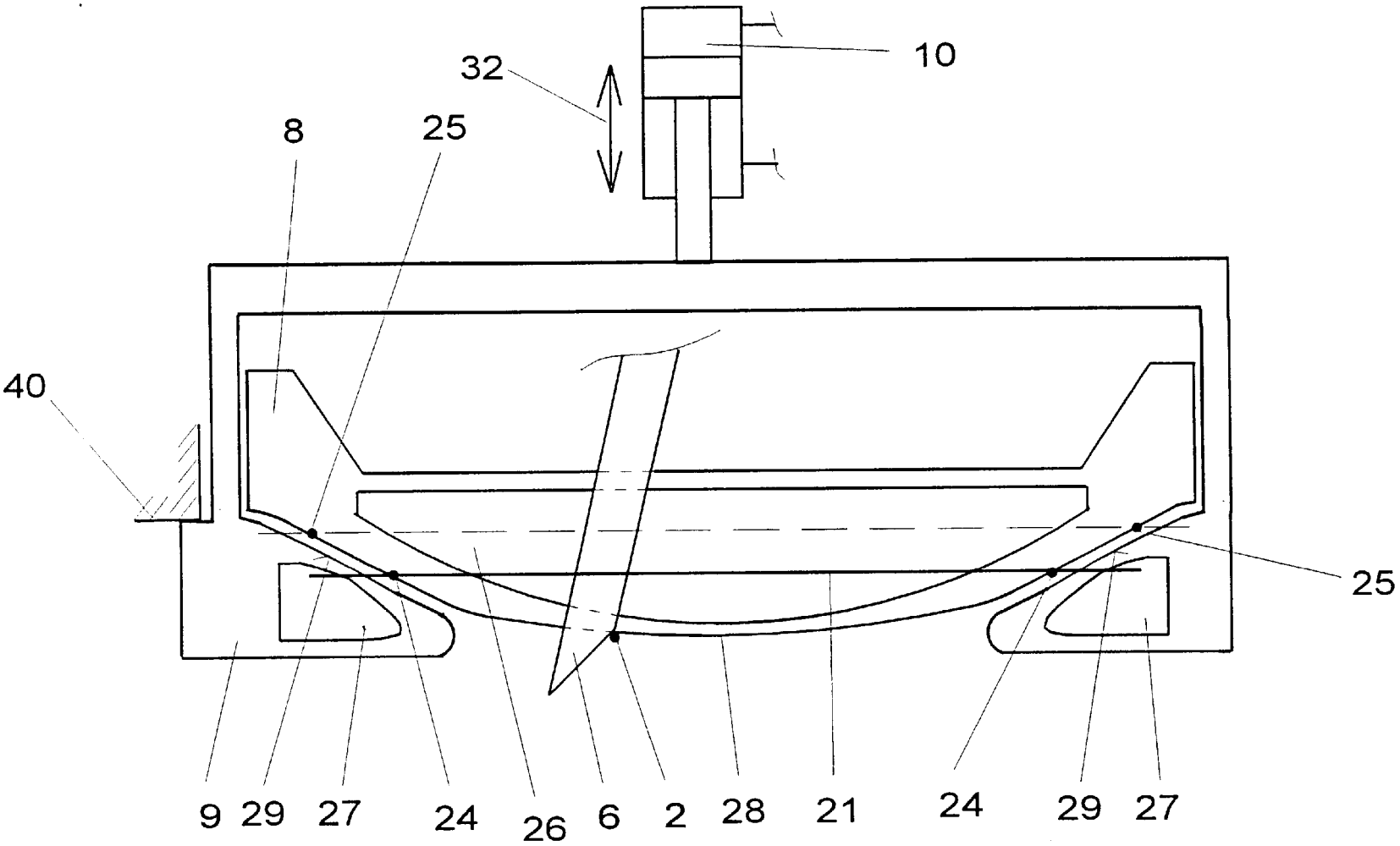

FIG. 5 shows a further embodiment of a traversing apparatus with a layout very similar to the embodiment of FIG. 4. Insofar, the description thereof with reference to FIG. 4 as well as the description of its operation with reference to FIG. 4 are herewith incorporated by reference. Contrary to the embodiment of FIG. 4, the auxiliary guide plate 9 in the embodiment of FIG. 5 is made in U-shape. The leg ends possess an extension which forms opposite guiding edge 29 in each of the stroke end regions. The linear drive 10 that is provided for displacing the auxiliary guide plate engages a transverse strut which mounts the legs. This arrangement has the advantage that all drives and, thus, any connections are located on one side of the traversing plane. This is especially advantageous for the operation as well as for the yarn advance of the takeup machine.

Figure 6:
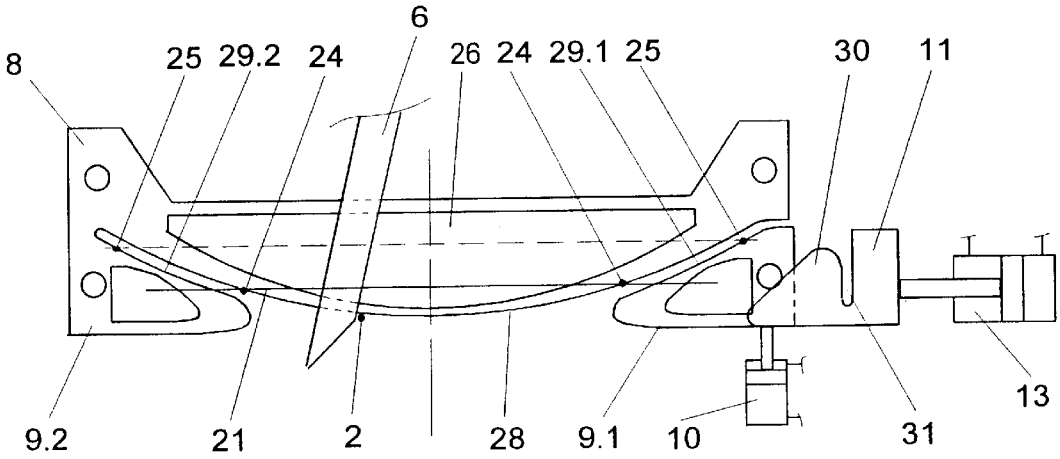
FIGS. 6 and 7 illustrate each a further embodiment of a traversing apparatus with an auxiliary guide plate consisting of a movable and a stationary sectional guide plate.

FIG. 6 illustrates a further embodiment of a movable auxiliary guide plate. In this embodiment, the auxiliary guide plate is divided into two sectional guide plates 9.1 and 9.2. The sectional guide plate 9.1 has an opposite guiding edge 29.1 and sectional guide plate 9.2 has an opposite guiding edge 29.2. The sectional guide plate 9.2 is stationarily connected to the main guide plate, whereas sectional guide plate 9.1 is made movable and adapted for movement by means of linear drive 10 in such a manner that opposite guiding edge 29.1 emerges from the traversing plane. In this arrangement, the yarn advance is the same as previously described with reference to the embodiment of FIG. 4.

As further shown in FIG. 6, the yarn catching element 11 is arranged in a plane parallel to sectional guide plate 9.1. The yarn catching element 11 has a guiding edge 30 that terminates in a catching slot 31. The yarn catching element is movable by means of linear drive 13 in direction 33 parallel to the traversing plane. The sectional guide plate 9.1 can be moved by means of linear drive 10 in direction 32 transverse to the traversing plane.

Figure 7:
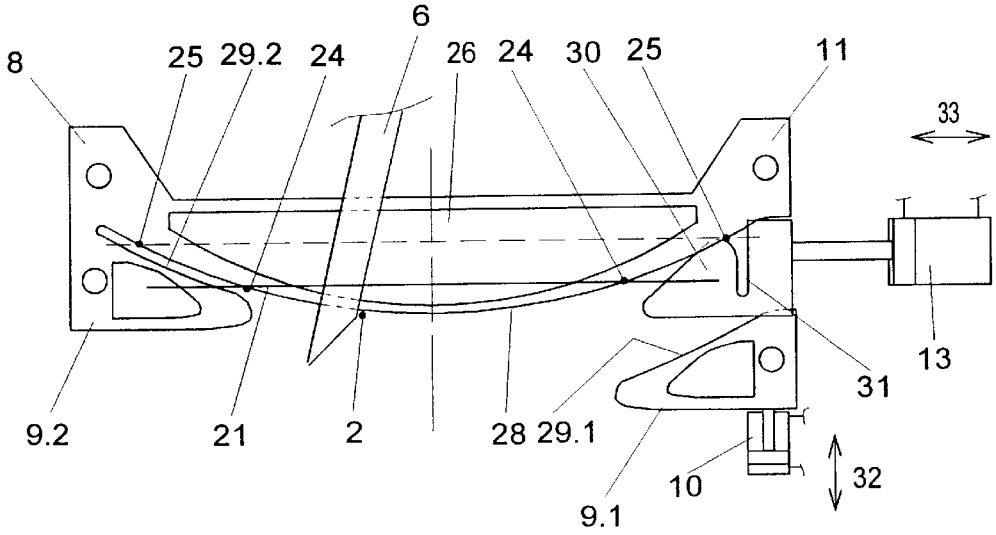

Shown in FIG. 7 is the situation, in which the sectional guide plate 9.1 is moved perpendicular to the traversing plane, so that opposite guiding edge 29.1 does no longer extend through traversing plane 21. In this situation, the yarn 2 guided by the rotary blade would not be subjected in the region between transition point 24 and stroke reversal point 25 to a guidance as is provided for deflecting the yarn from the traversing plane. Thus, the yarn will drop from the tip of the yarn guiding rotary blade before even reaching the stroke reversal point 25. However, the situation shown in FIG. 7 relates to a package doff. Consequently, at the same time as sectional guide plate 9.1 is displaced, the yarn catching element 11 is moved into the traverse stroke. In so doing, the yarn catching element 11 occupies a position in the region between transition point 24 and stroke reversal point 25. When the yarn 2 is now being guided by means of rotary blade 6, it will slide, after passing transition point 24, along the guiding edge 30 of yarn catching element 11 in the direction toward catching slot 31. At the end of guiding edge 30, the yarn 2 drops into the slot 31 of the yarn catching element. In so doing, the yarn is removed to a very large extent from the radius of action of the rotating blades. For purposes of guiding the yarn into slot 31, the rotary blade delivering the yarn barely passes over guiding edge 30 of the yarn catching element. The catching slot 31 is oriented such that the yarn can enter from the region of the rotating blades in direction toward the traversing plane. Thus, the yarn is guided in yarn catching element 11, which is again moved, for example for doffing a package, with the yarn out of the region of the traversing stroke. In this situation, the doff between the full package and the package to be newly formed is near. This doff proceeds in the same manner as in the known takeup machine disclosed in EP 0 374 536. To this extent, this prior art, which describes the exact sequences of movement of the turret with the two winding spindles in the doffing phase, is herewith incorporated by reference.

As soon as the yarn is secured in position on the full package by an extended movable sheet metal element (note FIG. 8), the yarn catching element 11 moves with the yarn to the right outside of the traverse stroke to a so-called catching position. In this position, the yarn is guided over a catching slot 20 of the new tube (note FIG. 1). Once the yarn is caught, the yarn catching element starts to move again to the left. In this phase, a yarn reserve is wound on the new tube. As the yarn catching element 11 moves in direction toward the stroke reversal point, sectional guide plate 9.1 moves simultaneously to its operating position. In this instance, there occurs again a harmonized movement of the sectional guide plate and the yarn catching element. While the yarn catching element 11 moves to the left, the reentering opposite guiding edge 29.1 lifts the yarn continuously out of slot 31 in yarn catching element 11. Shortly before reaching a delivery position of the yarn catching element, the yarn is totally guided out of slot 31 and, thus, returned to the traversing apparatus. This delivery position of the yarn catching slot is located only a very short distance outside of the traverse stroke, so that the traversing yarn is unable to touch the yarn catching element still being there. Meanwhile, the opposite guiding edge 29.1 of sectional guide plate 9.1 has totally moved to its operating position. Thus, the yarn can again be traversed in normal manner.

The exact adaptation of the movements of the sectional guide plate and of the yarn catching slot may occur via software-controlled pneumatic circuit elements and the separate linear drives 10 and 13 or, however, by means of a switching gear unit positively coupled with only one linear drive.

However, in the embodiment of the traversing apparatus as shown in FIGS. 6 and 7, it is also possible to provide the second sectional guide plate 9.2 with a drive. This will permit movement of sectional guide plates 9.1 and 9.2 during the winding cycle in such a manner that an alternate or equilateral traverse stroke reduction can be adjusted. By this measure, it is possible to realize to a limited extent a stroke modification during the winding cycle. In this process, the sectional guide plate with its respective opposite guiding edge is moved out of the traversing plane, so that prior to reaching the stroke reversal point the yarn slides from the guiding rotary blade well ahead of time. The yarn is then taken over and returned by the blade rotating in opposite direction.

Figure 8:
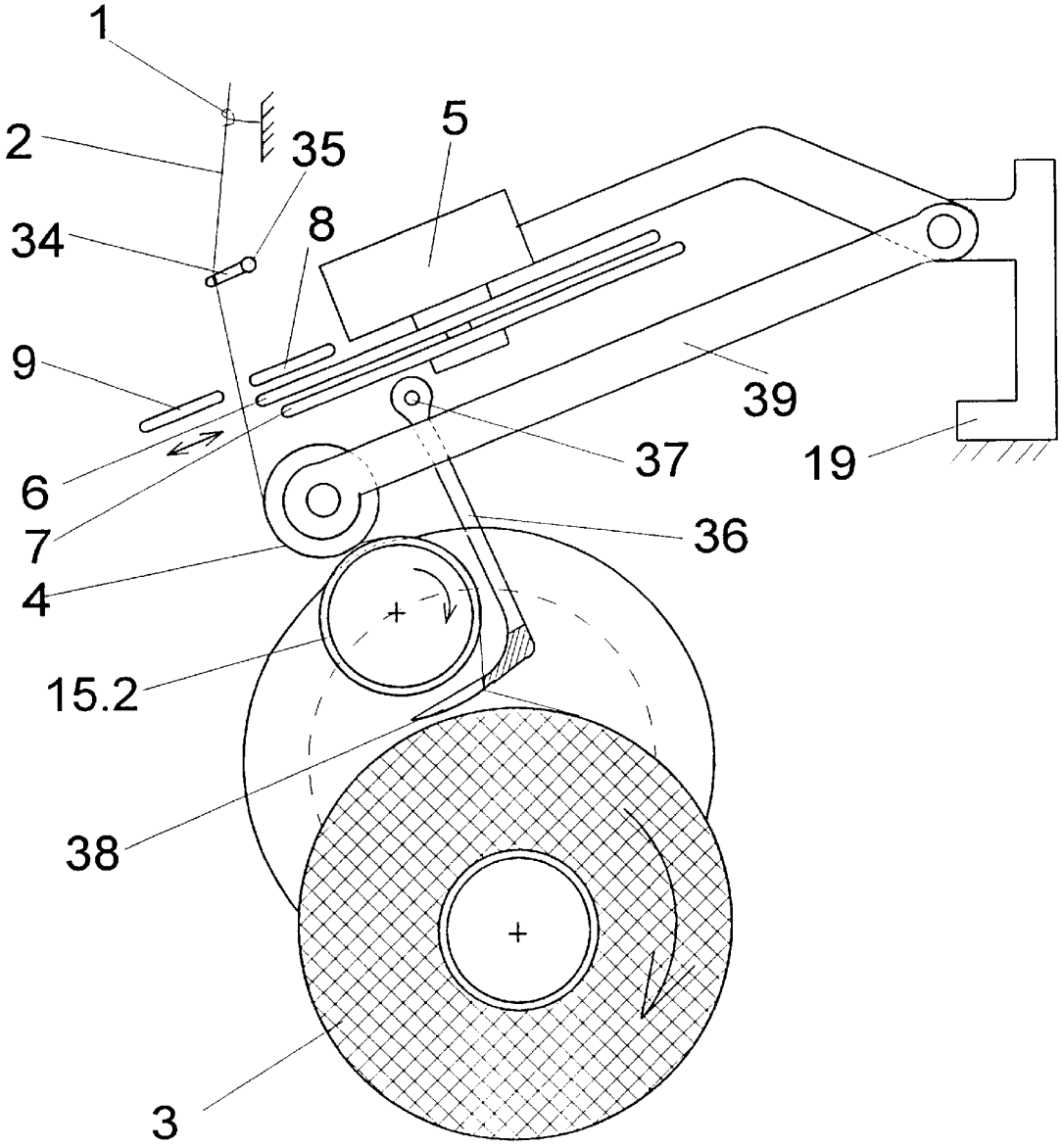
FIG. 8 shows a further embodiment of a winding machine in the doffing phase while transferring the yarn.

FIG. 8 illustrates a further embodiment of a winding machine in the doffing phase. This takeup machine corresponds essentially to the takeup machine known from EP 0 374 536, and corresponding U.S. Pat. No. 5,029,762, which are herewith incorporated by reference. In the present embodiment, the yarn 2 is removed from the traversing apparatus by means of a lifting device 34. The lifting device is attached for rotation to an axle 35. In this situation, the auxiliary guide plate 9 is extended so far that the yarn can advance unhindered from lifting device 34 onto the contact roll 4. Between empty tube 15.2 and package 3, a rocker arm 36 is moved which guides yarn 2 with a sheet metal element 38 such that yarn 2 advances onto full package 3. The lifting device 34 itself or a yarn catching element, as shown in FIGS. 6 and 7, guides the yarn out of the traversing range, until the yarn now extending obliquely to the sheet metal element passes over the catching slot of empty tube 15.2. Sheet metal element 36 is mounted for rotation to an axle 37. After yarn 2 has been caught on empty tube 15.2 in the catching slot thereof and, thus, the yarn is torn between the full package 3 and the empty tube 15.2, a new winding cycle can start. To this end, lifting device 34 is positioned such that yarn 2 returns again to the traversing range. At the same time, auxiliary guide plate 9 returns to its operating position.

In the configuration of the takeup machine with the main guide plate and auxiliary guide plate extending in planes parallel to one another, it is possible to increase with advantage the looping of the yarn, in particular in the region of the stroke reversal, so that the guiding edge of the main guide plate and the guiding edge of the auxiliary guide plate overlap. Such an arrangement, as is described, for example in DE 34 17 457, permits variation of the trailing length. In addition, it permits adjustment of any desired yarn tension.

In this connection, it should be explicitly mentioned that the winding machine of the present invention includes likewise such rotary blade type apparatus, in which the yarn is displaced over atraverse stroke by means of a plurality of rotary blades in side-by-side arrangement.

We claim:

1. A yarn winding apparatus for winding an advancing yarn onto a rotating bobbin to form a yarn package, and including traversing means for reciprocating an advancing yarn transversely to its advance direction over a predetermined traverse stroke and so as to define a traverse plane, said traversing means comprising at least two guide arms mounted for rotation about closely adjacent parallel or coaxial axes so that the rotating arms define closely adjacent parallel planes and the extremity of each rotating arm is adapted to pass along the traverse plane, drive means for rotating each of the arms in opposite directions so that one arm moves in a direction toward one end of the traverse stroke and the other arm moves in the opposite direction toward the other end thereof, a main yarn guide plate mounted on one side of the traverse plane and defining a main guide edge which extends in a direction generally parallel to the traverse stroke and through the traverse plane in a medial portion of the yarn traverse stroke to thereby guide the yarn and control its traversing speed, an auxiliary yarn guide plate in at least one of the end regions of the traverse stroke and positioned on the other side of the traverse plane, with the auxiliary guide plate defining an auxiliary guide edge which opposes the main guide edge, and means mounting the auxiliary yarn guide plate for relative movement with respect to the main yarn guide plate in a direction transverse to the traverse plane between an operating position wherein the auxiliary guide edge extends through the traverse plane and a withdrawn position wherein the auxiliary guide edge extends to a lesser extent or does not extend through the traverse plane.

2. The yarn winding apparatus as defined in claim 1 wherein the main guide plate and the auxiliary guide plate extend in a common plane.

3. The yarn winding apparatus as defined in claim 1 wherein the main guide plate and the auxiliary guide plate are arranged upstream of the two rotary guide arms in the direction of the yarn advance.

4. The yarn winding apparatus as defined in claim 1 wherein said drive means for rotating the arms is located on said one side of said traverse plane.

5. The yarn winding apparatus as defined in claim 1 further comprising a yarn catching element having a guiding edge and a catching slot, with said yarn catching element being mounted for movement in a direction parallel to the traversing plane and between a yarn catching position wherein the guiding edge and catching slot are within the traverse stroke, and a removed position outside of the traverse stroke, and such that when the auxiliary yarn guide plate is moved to its withdrawn position and the yarn catching element is moved to its yarn catching position, the traversing yarn slides along the guiding edge and drops into the slot of the yarn catching element.

6. The yarn winding apparatus as defined in claim 5 wherein the movement of the yarn catching element between its yarn catching position and its removed position, and the movement of the auxiliary yarn guide plate between its operative position and its withdrawn position are coupled.

7. The yarn winding apparatus as defined in claim 5 wherein the yarn catching element and the auxiliary yarn guide plate are positioned such that during movement of the auxiliary yarn guide plate from its withdrawn position to its operating position, and movement of the yarn catching element from its removed position to its yarn catching position, the auxiliary guide edge of the auxiliary yarn guide plate passes across the slot of the yarn catching element so as to remove a yarn from the slot and position the yarn within the traverse stroke.

8. The yarn winding apparatus as defined in claim 1 further comprising a stop for limiting the movement of the auxiliary yarn guide plate so as to define its operating position.

9. The yarn winding apparatus as defined in claim 1 wherein the main guide edge does not extend through the traversing plane adjacent either of the end regions of the traverse stroke.

10. The yarn winding apparatus as defined in claim 1 wherein the main yarn guide plate is fixed with respect to the traverse plane.

11. A yarn winding apparatus for winding an advancing yarn onto a rotating bobbin to form a yarn package, and including traversing means for reciprocating an advancing yarn transversely to its advance direction over a predetermined traverse stroke and so as to define a traverse plane, said traversing means comprising at least two guide arms mounted for rotation about closely adjacent parallel or coaxial axes so that the rotating arms define closely adjacent parallel planes and the extremity of each rotating arm is adapted to pass along the traverse plane, drive means for rotating each of the arms in opposite directions so that one arm moves in a direction toward one end of the traverse stroke and the other arm moves in the opposite direction toward the other end thereof, a main yarn guide plate mounted on one side of the traverse plane and defining a main guide edge which extends in a direction generally parallel to the traverse stroke and through the traverse plane in a medial portion of the yarn traverse stroke to thereby guide the yarn and control its traversing speed, an auxiliary yarn guide plate in each of the end regions of the traverse stroke and positioned on the other side of the traverse plane, with the auxiliary guide plates each defining an auxiliary guide edge which opposes the main guide edge, and means mounting at least one of the auxiliary yarn guide plates for relative movement with respect to the main yarn guide plate in a direction transverse to the traverse plane between an operating position wherein the associated auxiliary guide edge extends through the traverse plane and a withdrawn position wherein the associated auxiliary guide edge extends to a lesser extent or does not extend through the traverse plane.

12. The yarn winding apparatus as defined in claim 11 wherein the auxiliary yarn guide plates are fixedly interconnected so as to be moveable in unison by the mounting means.

13. The yarn winding apparatus as defined in claim 11 wherein the mounting means is operatively connected to one of the auxiliary yarn guide plates and the other of the auxiliary yarn guide plates is fixedly mounted with respect to the main yarn guide plate.

14. The yarn winding apparatus as defined in claim 11 wherein the main yarn guide plate is fixed with respect to the traverse plane.

* * * * *